US006704427B2

(12) United States Patent
Kearey

(10) Patent No.: US 6,704,427 B2
(45) Date of Patent: Mar. 9, 2004

(54) ACOUSTIC TRANSDUCER WITH IMPROVED ACOUSTIC DAMPER

(75) Inventor: Steve Kearey, Arlington Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 09/792,327

(22) Filed: Feb. 23, 2001

(65) Prior Publication Data

US 2001/0033671 A1 Oct. 25, 2001

Related U.S. Application Data

(60) Provisional application No. 60/184,807, filed on Feb. 24, 2000.

(51) Int. Cl.[7] ..... H04R 1/20; H04R 9/08

(52) U.S. Cl. ..... 381/355; 381/353; 381/359; 381/369

(58) Field of Search ..... 381/355, 354, 381/345, 346, 359, 360, 358, 356, 122, 344, 174, 171, 170, 369, 177

(56) References Cited

U.S. PATENT DOCUMENTS

| | | | | |
|---|---|---|---|---|
| 3,671,684 A | | 6/1972 | Tibbetts et al. | |
| 4,450,930 A | | 5/1984 | Killion | |
| 4,525,817 A | * | 6/1985 | Takuya | 381/355 |
| 4,891,843 A | * | 1/1990 | Paulus et al. | 381/355 |
| 4,972,488 A | * | 11/1990 | Weiss et al. | 381/355 |
| 5,002,151 A | * | 3/1991 | Oliveira et al. | 381/355 |
| 5,574,794 A | * | 11/1996 | Valley | 381/355 |

FOREIGN PATENT DOCUMENTS

| | | |
|---|---|---|
| EP | 0 326 040 | 8/1989 |
| WO | WO 95/07014 | 3/1995 |
| WO | WO 98/35530 | 8/1998 |

* cited by examiner

*Primary Examiner*—Rexford Barnie
(74) *Attorney, Agent, or Firm*—Marshall, Gerstein & Borun LLP

(57) ABSTRACT

An acoustic damper for covering a housing inlet of a transducer is disclosed. The damper includes a mesh panel and a non-mesh periphery. The non-mesh periphery of the damper is adhesively attached to the housing of the transducer wherein the mesh panel covers the inlet. The non-mesh periphery of the damper inhibits the adhesive from wicking into the mesh panel. The damper is adaptable for attachment of a film. The film is capable of cooperating with a backplate to form a motor assembly of the transducer.

3 Claims, 3 Drawing Sheets

ACOUSTIC TRANSDUCER WITH IMPROVED ACOUSTIC DAMPER

RELATED APPLICATIONS

This application claims priority to U.S. Provisional Patent Application entitled, "Acoustic Transducer with Improved Acoustic Damper," Ser. No. 60/184,807, filed Feb.24, 2000.

TECHNICAL FIELD

The present invention relates generally to acoustic transducers, and, more particularly, to acoustic dampers for acoustic transducers.

BACKGROUND OF THE INVENTION

Transducers, and particularly microphones, are typically utilized in hearing aids. Generally, electret transducers comprise a housing having an opening, inlet, that communicates with the interior of the housing. An electret motor assembly including a diaphragm adjacent a charged plate having an electret material formed thereon is mounted within the housing to define acoustic chambers on opposite sides of the motor assembly.

An acoustic signal enters one of the chambers via the inlet of the housing, allowing the diaphragm to respond thereto. Air pulsations created by the vibrations of the diaphragm pass from one acoustic chamber to the other acoustic chamber.

The electret material on the charged plate is operably connected to electronic circuitry to permit electroacoustical interaction of the diaphragm and electret material on the backplate to create an electrical signal representative of the acoustic signal. As is known, the converse operation may be provided by the transducer in that an electrical signal may be applied to the electret on the backplate to cause the diaphragm to vibrate and thereby to develop an acoustic signal that can be coupled out of the acoustic chamber.

Common in microphones, a port tube extends from or is integral with the inlet of the housing and provides acoustic resistance to the acoustic signal before it reaches the diaphragm. However, it is preferable that a hearing aid have the smallest dimensions possible, and a port tube increases the overall size of the microphone.

An acoustic transducer in accordance with the present invention provides an inexpensive and simple solution to eliminate the drawbacks of the prior acoustic transducers.

SUMMARY OF THE INVENTION

One embodiment of the present invention is directed to an acoustic damper for a transducer. The transducer comprises a housing having an inlet. The damper has a mesh panel and non-mesh periphery wherein the mesh panel covers the inlet. The non-mesh periphery of the damper is attached to the housing with an adhesive. The non-mesh periphery inhibits the adhesive from wicking into the mesh panel.

Another embodiment of the present invention includes a film operably attached to the non-mesh periphery of the damper. The film and the damper form a diaphragm assembly. The interior of the film is free to move without touching the mesh panel. The diaphragm assembly is adaptable for cooperating with a backplate to form a motor assembly.

One object of the present invention is to provide an acoustic damper having a reduced dimension for a transducer.

Another object of the present invention is to provide a diaphragm assembly having an acoustic damper, the diaphragm assembly capable of being adapted to a motor assembly of a transducer.

Other features and advantages of the present invention will be apparent from the specification taken in conjunction with the following drawings.

DETAILED DESCRIPTION OF THE PREFERRED EMBODIMENT

Figure 2:
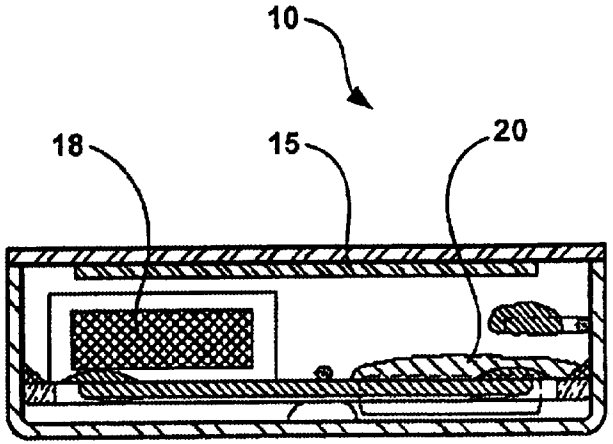
FIG. 2 is a cross-sectional view of the acoustic transducer of FIG. 1 taken along line A—A.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 3:
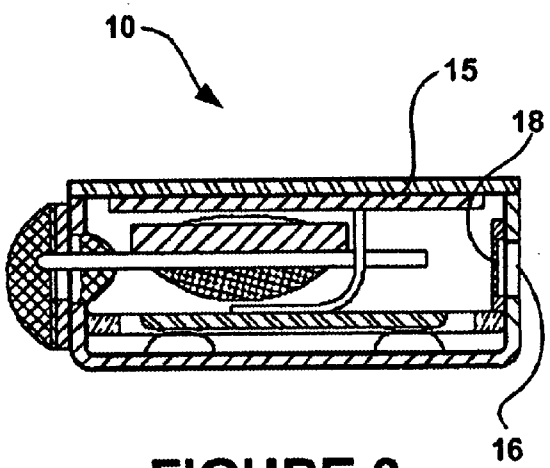
FIG. 3 is a cross-sectional view of the acoustic transducer of FIG. 1 taken along line B—B.
Figure 1:
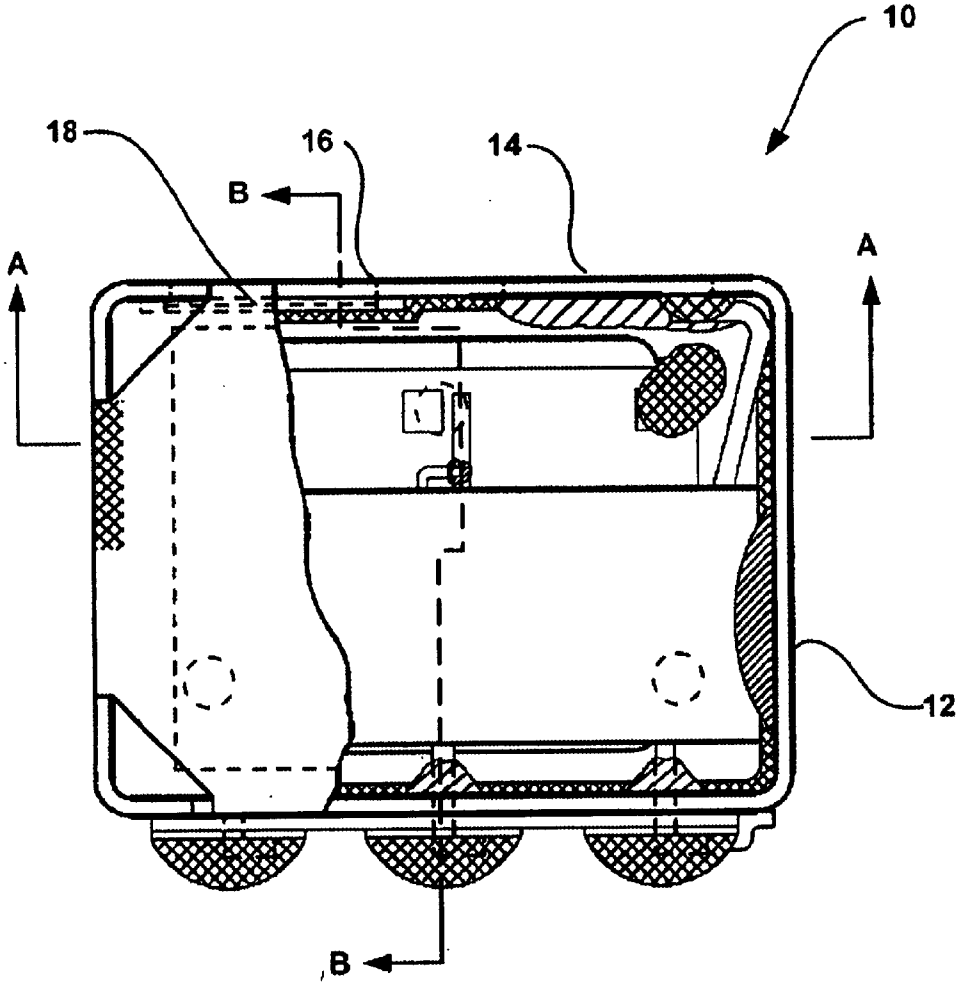
FIG. 1 is a partial cross-sectional view of an acoustic transducer of the present invention.
Figure 5:
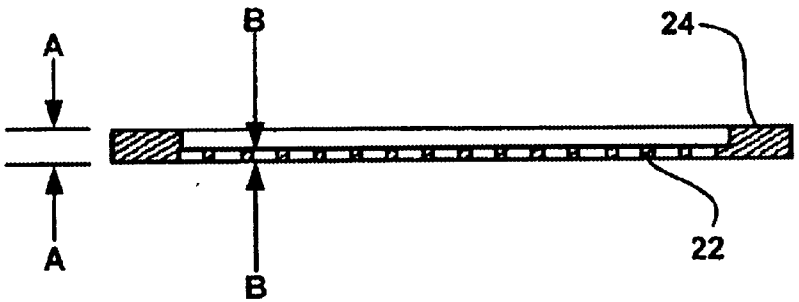
FIG. 5 is a left side view of the acoustic damper of FIG. 4.
Figure 6:
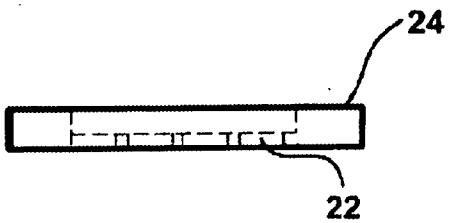
FIG. 6 is a bottom side view of the acoustic damper of FIG. 4.
Figure 4:
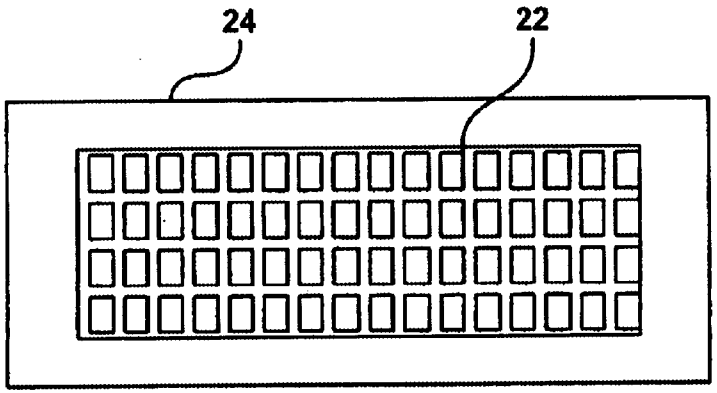
FIG. 4 is a plan view of an acoustic damper of the present invention.

A microphone, generally designated 10, for a hearing aid (not shown) adapted to be disposed within an ear canal is illustrated in FIGS. 1–3. The microphone 10 is disposed within a housing 12 having a housing wall 14. A sound inlet slot 16 extends through the housing wall 14. The sound inlet slot 16 is covered by a damping screen 18, as further explained below. An electret assembly 20 is disposed within the housing 12, as is conventional circuitry integrated into a thick film transistor 15.

A port inlet tube, when attached to the housing of a microphone provides acoustic resistance to incoming sound. The port inlet tube also provides an impediment to foreign matter entering the housing 12. With the port tube removed, the sound inlet slot 16 is left exposed to undamped acoustics and foreign matter that will find its way into the housing 12. However, it is sometimes preferred to remove the port inlet tube to reduce the size of the microphone 10.

The present invention provides a damping screen 18 placed over the sound inlet slot 16 to provide an acoustic resistance and a barrier to foreign matter. The damping screen 18 is a preferably a mesh material and has apertures that allow sound to pass through it. A glue is used to hold the damping screen 18 in place. However, a varying amount of glue may be unintentionally placed on the damping screen 18 over the sound inlet slot 16. By capillary action or other effects, the glue can also "wick" into the damping screen 18 over the sound inlet slot 16. If the glue adhering the damping screen 18 to the housing 12 is also present in the area over the sound inlet slot 16, the acoustic effects of the damping screen 18 are altered and the microphone's response to acoustic vibration impaired.

In order to prevent glue from entering the damping screen 18 over the sound inlet slot 16, the present invention forms the damping screen 18 with a non-mesh portion 24 along the periphery of a mesh portion 22. Glue adhesive is then applied to the non-mesh portion 24 in order to secure the damping screen 18 to the housing 12. In a preferred embodiment, a thickness A of the non-mesh portion 24 is greater than a thickness B of the mesh portion 22. While it is preferred that the non-mesh periphery 24 be continuous (in order to maximize glue area), it is within the scope of the present invention to provide a non-mesh portion that surrounds only a portion of the periphery of the mesh portion 22.

The mesh portion 22 and non-mesh portion 24 are preferably formed as a single unit from electroformed nickel. However, it is within the scope of the present invention to form the mesh portion 22 and the non-mesh portion 24 as two separate units, such as by forming the non-mesh portion 24 around the periphery of the mesh portion 22 of a different material.

The mesh portion 22 is formed such that it provides apertures that exhibit the level of acoustic resistance desired for the microphone in which it is placed. This is accomplished by varying the number, size and spacing of apertures within the mesh. However, a damping screen 18 that provides little or no acoustic resistance is within the scope of the present invention. In this instance the damping screen 18 would act as an acoustically transparent barrier to foreign matter.

Figure 7:
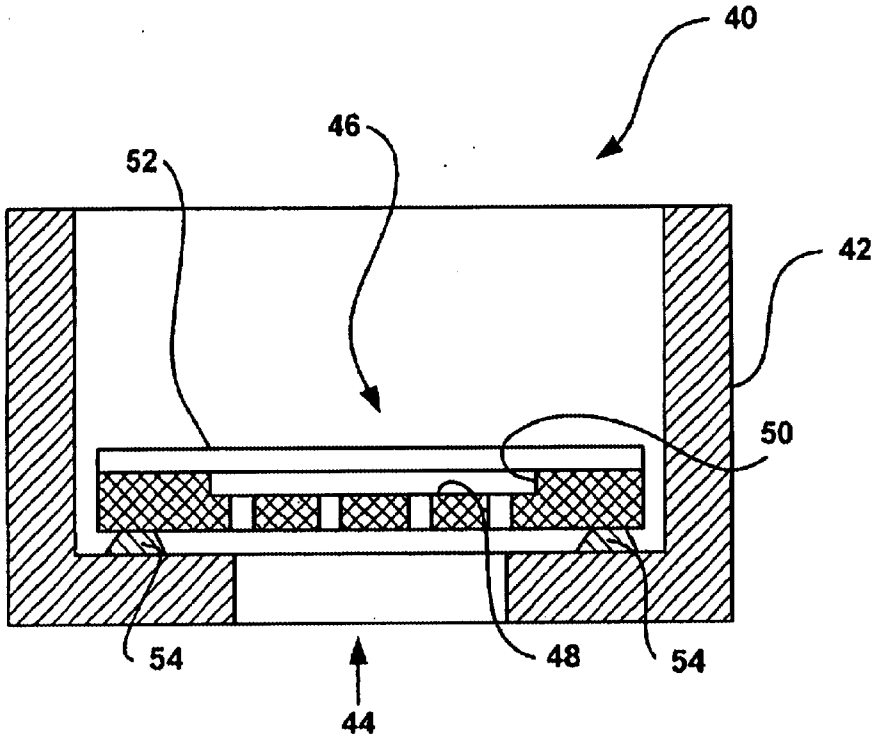
FIG. 7 is a cross-sectional view of an alternative embodiment of the present invention; and, FIG. 8 is a cross-sectional view of an alternative embodiment of the present invention.

In an another embodiment described in FIG. 7, there is shown a simplified drawing of a microphone 40 having a housing 42 defining a sound inlet slot 44. In this configuration, an acoustic damper 46 is formed having a mesh portion 48 and a non-mesh portion 50 as in the previous embodiment. In addition, a film 52 of an electret assembly (not shown) is attached to the non-mesh portion 50 and spaced apart from the mesh portion 48. In this manner, the film 52 will not touch the acoustic damper 46 in its normal range of travel and will perform in a conventional manner.

Figure 8:
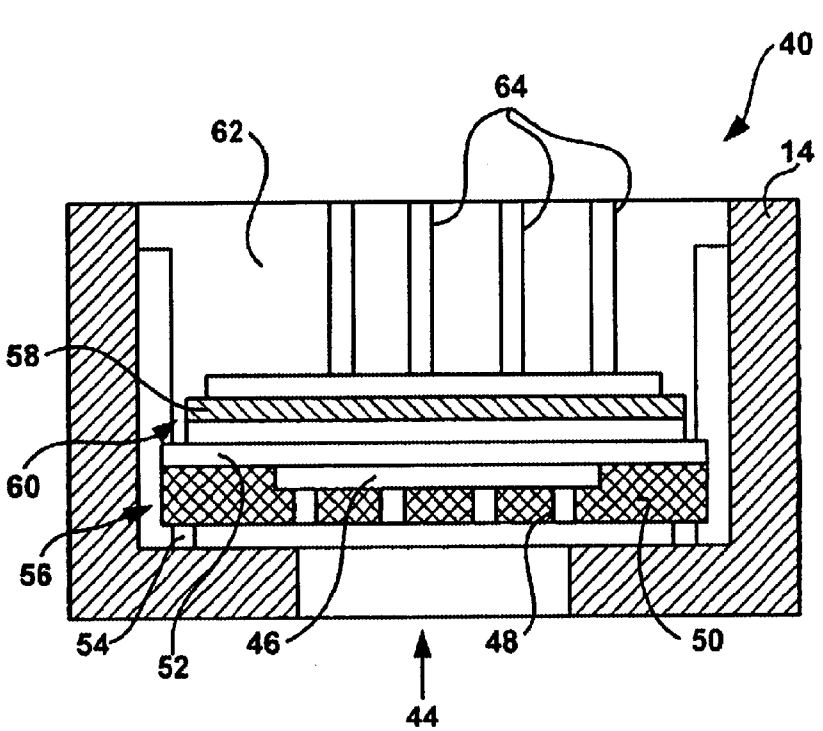

In this embodiment, the film 52 operably attached to the acoustic damper 46 forms a diaphragm assembly 56. The diaphragm assembly 56 is adhesively attached to the housing 42 by glue 54. The diaphragm assembly 56 is adaptable for cooperation with a backplate 58 to form an electret motor assembly 60. FIG. 8. The film 52 of the diaphragm assembly 56 is metallized to create an electrically active portion, i.e., movable electrode, of the diaphragm assembly. A frame 62 is utilized to space the diaphragm assembly 56 apart from the backplate 58, thus enabling the diaphragm assembly and the backplate to function as the motor assembly 60. The film 52, together with the backplate 58, determines the capacitance of the motor assembly 60. Acoustic signals, facilitated by conduits 64 in the frame 62 and the inlet 44, will affect the motor assembly; thus varying the capacitance. Additionally, an amplifier can be electrically connected to the motor assembly.

While the specific embodiment has been illustrated and described, numerous modifications come to mind without significantly departing from the spirit of the invention, and the scope of protection is only limited by the scope of the accompanying claims.

I claim:

1. An acoustic transducer comprising:

a housing having an inlet;

an acoustic damper, the damper having a mesh panel encircled within a non-mesh periphery;

a metallized film connected to the periphery of the damper, the film being spaced apart and substantially parallel to the mesh panel, the portion of the film adjacent the periphery of the damper capable of vibrating; and, a charged backplate mounted to the housing, the backplate having an electret material thereon, and the entire backplate spaced a distance from the film, the backplate cooperating with the film to create an electrical signal, wherein the backplate is attached to a frame, the frame being attached to the housing.

2. The acoustic transducer of claim 1 wherein the frame has a conduit to facilitate the transportation of an acoustic signal to the backplate.

3. The acoustic transducer of claim 1 wherein the non-mesh periphery is continuous.

* * * * *